US006062007A

United States Patent [19]

Cargill

[11] Patent Number: 6,062,007

[45] Date of Patent: May 16, 2000

[54] STIRRUP PAD

[75] Inventor: Katherine E. Cargill, Boulder, Colo.

[73] Assignee: Inteli-Brite, LLC, Boulder, Colo.

[21] Appl. No.: 09/253,736

[22] Filed: Feb. 22, 1999

[51] Int. Cl.[7] ..... B68C 3/00

[52] U.S. Cl. ..... 54/47

[58] Field of Search ..... 54/46, 47, 48

[56] References Cited

U.S. PATENT DOCUMENTS

| | | | |
|---|---|---|---|
| 1,639,073 | 8/1927 | Berbaum | 54/47 |
| 5,172,538 | 12/1992 | Luger | 54/47 |
| 5,930,986 | 8/1999 | Meaghan et al. | 54/47 |

*Primary Examiner*—Thomas Price
*Attorney, Agent, or Firm*—Charles C. Corbin

[57] ABSTRACT

A pad for a horseback rider's stirrup is adapted for being removably installed in the stirrup, the stirrup having a horizontal foot platform with top and bottom surfaces and an elongate aperture therein, the pad comprised of three layers of polymeric materials of distinct properties and joined to each other by molecular cross-linking. A thin, flexible, high coefficient of friction top layer is adapted for griping, and a thicker mid layer adapted for dampening shock forces, and there is a harder, flexible lower layer. A portion of the pad, integral with the lower layer is adapted to engage the platform aperture and bottom to removably anchor the pad to the stirrup, and the top surface of the platform engages the bottom of the lower layer to vertically support the pad.

7 Claims, 1 Drawing Sheet

STIRRUP PAD

BACKGROUND OF THE INVENTION

1. Field of the Invention

The present invention relates to stirrups for horseback riders, and more particularly to a pad that can be mounted to a stirrup to reduce foot slippage and dampen shock transmitted to a rider by a horse in motion.

2. Description of the Prior Art

Horseback riders experience a bouncing sensation, often unsettling, caused by the horse in motion. Bouncing in the saddle can produce bodily aches and pains in inexperienced riders and even experienced equestrians feel the effects of a strenuous ride. Riders of the "English" style, particularly riders who compete with show jumpers, know the concussion and impact to the body that ensues when a horse touches ground at the completion of a jump. Tremendous power is exerted by a horse in motion, particularly during hard galloping or in jumping over high obstacles and this can exert high G forces which initially are absorbed by the horse's legs, then travel on from there and dissipate throughout the horse's body. It is axiomatic that the horseback rider will also be affected by the impact created when hooves hit or leave the ground.

While a good amount of shock is absorbed by the rider's knees and legs, the force transmitted to the rider is often so strong that a good proportion of the shock is not dissipated but continues up through the rider's body, helping to create a loss of rider control and safety. To address these problems attention naturally focuses on the first point of impact to rider's body, namely the rider's feet in the stirrups. Accordingly, the prior art reveals a few developments that attempt to addresses this problem. Thus in U.S. Pat. No. 3,512,339 to Roberts, there is shown a stirrup-mounted cushion assembly that essentially is comprised of a plurality of interiorly mounted springs acting against a tubular sleeve, all of which are encased within a rectangular cage. The saddle strap engages the cage in such manner that shock associated with horseback riding is absorbed in the assembly.

U.S. Pat. No. 4,936,081 shows a shock-absorbing stirrup that features an elastomeric, energy absorbing ring mounted in the upper part of stirrup-shaped rigid structure. It is noted that a closed-cell rubber pad is glued to the lower part of the stirrup structure for the purpose of adding comfort to the rider's feet, and not as a shock absorbing device. Finally, U.S. Pat. No. 5,172,538 shows a safety stirrup pad of a durable plastic or relatively hard rubber that has an inclined foot rest designed to support a foot at an upwardly inclined orientation.

In spite of advantages that may be brought to the horseback rider by the prior art examples, they all have their apparent limitations, and the need remains for improvements.

SUMMARY OF THE INVENTION

In view of the foregoing it is a general object of the present invention to provide an improved means for dampening the impact that is ordinarily transferred to a horseback rider whose feet are in the stirrups, which impact also effects the rider's control and safety.

A more particular object is to improve riding safety by providing a stirrup pad with enhanced ability to grip the sole of a rider's boot.

Another object of the invention is to provide a stirrup pad that will aid the rider in achieving greater riding performance, comfort and control.

A further object is to provide a stirrup pad that is adapted to be removably mounted to a conventional stirrup.

Accordingly, these and other objects and advantages are provided by a stirrup pad according to the present invention which is designed for being removably mounted in a conventional metal stirrup frame of the type that has a horizontal foot platform with generally flat upper and bottom surfaces, and an oblong aperture there-through.

The pad incorporates a novel molded arrangement of three distinct polymeric materials, arrayed in layers that are integrally connected to each other by molecular cross-linking. Accordingly, the pad of the invention features an upper layer, a mid-layer, and a lower layer. A portion of the pad, integral with the lower layer is adapted for removably anchoring the pad to the stirrup frame. The lower layer is engaged by the upper surface of the foot platform so as to vertically support the pad.

The upper layer is the anti-slip component of the pad and is flexible and thin, and is characterized by its heightened ability to grip the bottom of a rider's boot with conformity for added control and safety, and is composed of relatively soft yet durable material having a high coefficient of friction. Further, the upper layer is of a minimal thickness that allows it to serve essentially as a flexible non-slip (cover) for the underlying, molecularly cross-linked dampening layer. Additionally, in a preferred embodiment, the top surface of the upper layer is textured or otherwise roughened to further enhance the gripping capability of the upper layer.

The integral mid-layer is relatively thick, and is formed of a volume-incompressible, nonfoamed material that is characterized by its shock-dampening properties.

DETAILED DESCRIPTION OF THE INVENTION

Figure 1:
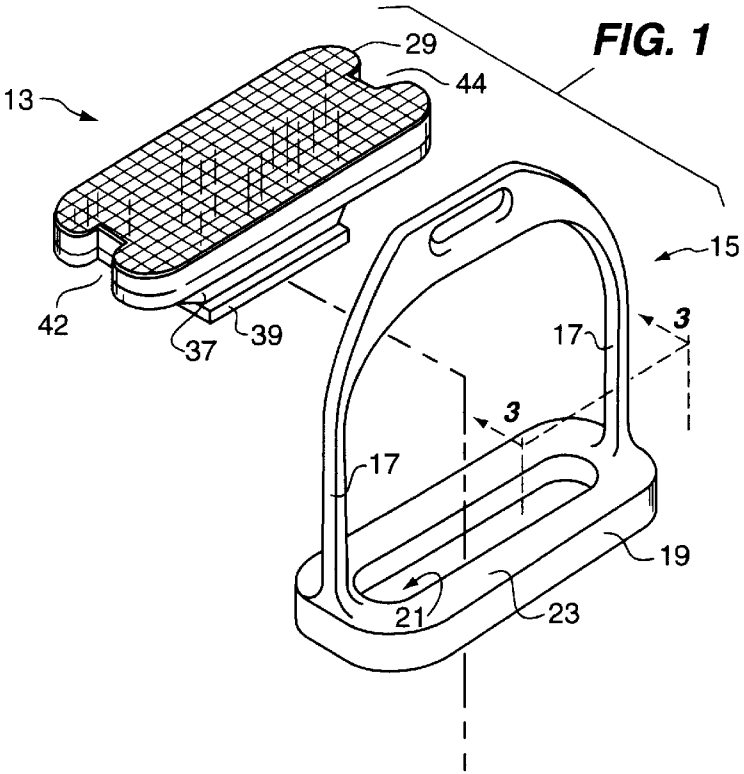
FIG. 1 is a partial, perspective view showing a preferred embodiment of a stirrup pad according to the present invention, and the stirrup to which it can be removably mounted.
Figure 3:
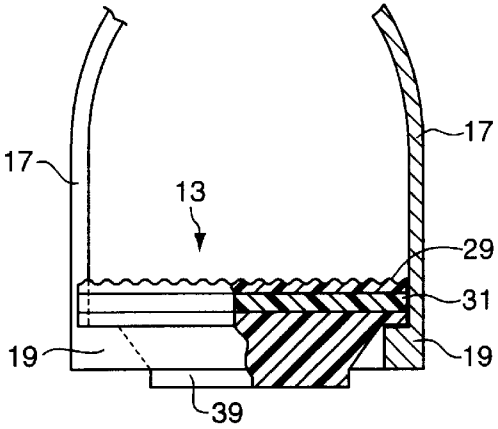
FIG. 3 is a partial sectional view, of the installed stirrup pad of FIG. 1, taken along the line 3—3 of FIG. 1.
Figure 4:
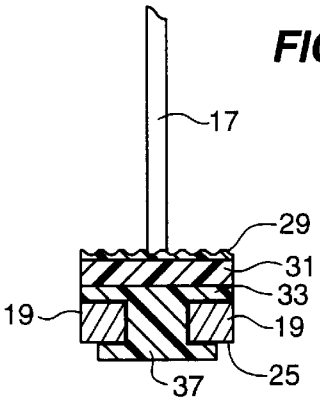
FIG. 4 is a sectional view of the installed stirrup pad of FIG. 1; taken along the line 4—4 of FIG. 1.

Referring now to the drawings, FIG. 1 shows a preferred embodiment according to the present invention, of a pad 13 which is adapted to be removably installed in a conventional stirrup 15 that has a metal frame, including yoke arms 17, and a foot platform 19 that has an oblong aperture 21, a top surface 23, and a bottom surface 25, shown in FIGS. 3 and 4.

Figure 2:
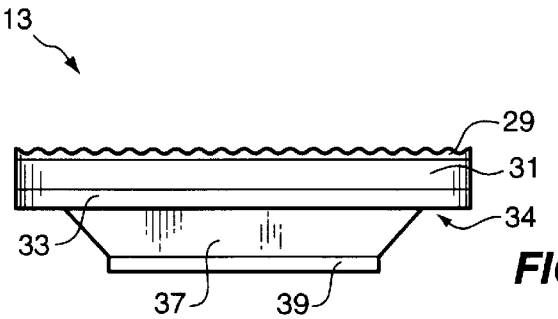
FIG. 2 is a side elevational view of the pad of FIG. 1.

As FIGS. 2 and 3 show, the pad 13 has a relatively thin upper layer 29, mid-layer 31 and lower layer 33. The lower part of pad 13 is integral with, and comprised of the same relatively hard, flexible material as the lower layer 33, and has a trunk portion 37 and bottom flanges 39. The flanges 39 are flexible enough to be pushed through the aperture during installation, upon which the trunk 37 engages the aperture 21 and flanges 39 engage the stirrup bottom 25 as shown in FIG. 3, to hold the pad against lateral and upward movement, respectively. Lower layer 33 and portions 37 and 39 are preferably made of a polyether that is rigid enough to securely hold the pad 13 in place in the stirrup aperture 21.

The thin upper layer 29 is preferably comprised of an nonfoamed high coefficient of friction urethane material with a coefficient of friction greater than 2.5. Also in a preferred embodiment, the top of the upper layer 29 is knurled as shown in the drawings to further enhance the gripping capabilities of upper layer 29.

Upper layer 29 is of a minimal thickness sufficient to allow it to serve as an anti-skid, conforming cover for the underlying shock dampening mid-layer 31.

The mid-layer 31 is preferably comprised of a long molecular chain polyether that is volume-incompressible and which exhibits excellent shock dampening properties.

FIGS. 3 and 4 best show the installed position of pad 13 wherein the bottom 34 of the lower layer is directly supported by the stirrup top surface 23. The notches 42 and 44 shown in FIG. 1 at the opposite ends of the pad will accommodate the yoke arms 17 upon installation of the pad.

FIGS. 3 and 4 best show the installed position of pad 13 wherein the bottom 34 of the lower layer is directly supported by the stirrup top surface 23. The notches 42 and 44 shown in FIG. 1 at the opposite ends of the pad will accommodate the yoke arms 17 upon installation of the pad.

Shock forces generated during riding act upwardly by way of the foot platform 19 which transfers these forces to the lower layer 33 over which the upward forces tend to be spread evenly. During the same time the rider's boot is urged downwardly against the pad and is gripped by the top layer 29 and causes the mid-layer to resiliently deflect, and the shock force is effectively dampened.

While particular embodiments of the invention have been described, it should be understood that the invention is not limited thereto, and includes other variants and modifications that will readily occur to those persons of ordinary skill in the art, given the benefit of this disclosure. Thus it is intended that the invention be given its full scope and breath as defined in the claims which follow.

What is claimed is:

1. A pad for a horseback rider's stirrup, wherein the stirrup includes a horizontal foot platform with top and bottom surfaces, said pad having three contiguous layers of polymeric materials of distinct properties and joined to each other by molecular cross-linking, and said layers comprising:

a. a lower layer that is relatively hard and flexible with its bottom portion adapted for removably anchoring said pad to said foot platform upper surface to vertically support said pad;

b. a mid-layer having high force-dampening qualities and adapted to dampen shock force across said pad, and comprising a volume-incompressible and deflectable material; and c. a flexible, relatively thin upper layer comprised of a relatively soft, high coefficient of friction material.

2. A pad as defined in claim 1 wherein the top surface of said upper layer is textured.

3. A pad as defined in claim 1 wherein said upper layer is an elastomeric urethane material.

4. A pad as defined in claim 1 wherein said lower layer is substantially harder than said mid-layer.

5. A pad as defined in claim 1 wherein said mid-layer is a long molecular chain polyether material.

6. A pad as defined in claim 1 wherein said upper layer is an elastomeric urethane, said mid-layer is a nonfoam polyether, and said lower layer is a polyether.

7. A pad as defined in claim 1 wherein said upper layer has a coefficient of friction greater than 2.5.

* * * * *